United States Patent [19]

Wu

[11] 4,239,573

[45] Dec. 16, 1980

[54] METHOD AND EQUIPMENT FOR MANUFACTURE OF TARGET BOARDS FOR DARTS OR ARCHERY

[76] Inventor: Edward W. J. Wu, 62, Wu Chuan Si Er St.,, Taichung, Taiwan

[21] Appl. No.: 34,753

[22] Filed: Apr. 30, 1979

[51] Int. Cl.[3] ..... B29C 19/00; B29C 9/00; A63B 63/00; B32B 3/02

[52] U.S. Cl. ..... 156/245; 264/243; 264/308; 273/408; 428/64

[58] Field of Search ..... 156/245, 304; 264/243, 264/123, 308; 273/102 B; 428/64

[56] References Cited

U.S. PATENT DOCUMENTS 3,276,941 10/1966 Burns ..... 156/304

FOREIGN PATENT DOCUMENTS 407336 3/1934 United Kingdom ..... 273/102 B 553066 5/1943 United Kingdom ..... 273/102 B

*Primary Examiner*—William A. Powell
*Assistant Examiner*—Louis Falasco
*Attorney, Agent, or Firm*—Shoemaker and Mattare

[57] ABSTRACT

This invention relates to a method and equipment for manufacture of target boards for darts or archery, and more particularly a method and equipment with which a target board for darts or archery is made from a tightly pressed circular board. The board is made by joining two semi-circular hemp boards of equal thickness, tightly pressed, with a joining device. The semi-circular hemp boards are obtaind by cutting a tightly pressed, semi-cylindrical hemp bundle into plurality of semi-circular disc like boards of equal thickness. The tightly pressed, semi-cylindrical hemp bundle is formed from a large bunch of suitable hemp fibers using a forming press device directly.

1 Claim, 15 Drawing Figures

METHOD AND EQUIPMENT FOR MANUFACTURE OF TARGET BOARDS FOR DARTS OR ARCHERY

BACKGROUND OF THE INVENTION

A conventional method of manufacture of the target boards popularly used in darts games or archery is described as follows:

As shown in FIG. 1, first of all, a proper quantity of hemp fibers are wrapped tightly with PVC tapes b to become a bundle a (approximately 5–7 cm in diameter) prior to the press-forming process, then the hemp bundle wrapped with PVC tape b is cut with a knife into a plurality of small cylindrical parts c of equal thickness as that of a target board. Next, as shown in FIG. 1A, a suitable number of the small cylindrical parts c (just enough to constitute a target board) are laid and tightly arranged on a joining device and are then forced inwardly to become a disc-like, shrunk circular board. A circular plate d (usually a wooden plate) is attached manually thereon with glue f, and finally, a protection ring e is put around the shrunk circular board to become a completed target board. Upon reviewing the aforediscussed conventional manufacturing process, one could easily find many disadvantages as follows: (1) According to the conventional method, first of all, it is necessary to wrap PVC tapes around the small bunch of hemp fibers to become a tightly wrapped hemp bundle, which is then cut into small cylindrical parts of the same thickness as the target board, the process is time consuming and also there is a waste of material. Therefore it is costly. (2) As each small cylindrical part is wrapped with PVC tapes, the internal cohesion as a whole unit is lacking when the group of small cylindrical parts are pressed inwardly, therefore the completed target board is lacking in tightness and uniformity. (3) The cross section of each small cylindrical part after inward pressing shows irregular contacts with neighboring parts, which leads to an essential defect such as uneven surface F which requires many coats of glue to make the surface flat before the circular plate D can be attached smoothly. Therefore, it is obvious that the completed target board is not strong. Furthermore, because of the aforesaid reason, the quality of the prior art boards is poor and productivity of same is low.

SUMMARY OF THE INVENTION

The main object of this invention is to provide a new method and equipment for manufacture of target boards for darts or archery, in order that the aforesaid difficulties and disadvantages with the conventional manufacturing method can be thoroughly eliminated, and thus productivity can be increased, while cost is reduced, and the process is simplified. It is another object of this invention to provide a new method and equipment for darts or archery which reduces cost to a manufacturer.

The method of manufacture according to this invention has several special features and advantages as follows: (1) According to this invention a large bunch of hemp fibers are directly placed in a press-forming device and pressed tightly to become a semi-cylindrical hemp bundle, which eliminates the need of wrapping PVC tapes around the hemp fiber bunch prior to the pressing process, sewing material and labor. (2) The target board manufactured according to this invention has better uniformity, internal cohesion and contraction than a board manufactured according to a conventional method as the hemp fibers are more tightly and uniformly pressed with the method of this invention. (3) The target board manufactured according to this invention is made from two semi-circular hemp boards tightly pressed and joined together, the semi-circular hemp boards being obtained by cutting with a sawing machine into a tightly pressed, large hemp bundle into disc-like boards, therefore the surface of the target board is flat, even and smooth which will not be badly affected during the other process of manufacture. In comparision, a target board manufactured according to a conventional method is made from small hemp bundles that are obtained by cutting a slender hemp bundle into small parts of the same thickness as the target board before pressing those bundles together to become a board, thus taking a great deal of processing labor. (4) There are no wrinkles or trace of wrinkles on the surface of the target board manufactured according to this invention as the hemp fibers joined therein are evenly and uniformly distributed and tightly pressed together, thus the board has a beautiful appearance. In comparison, wrinkles or traces of wrinkles always appear, though insignificantly, on the surface of a target board manufactured according to the conventional method. This is because of the edges of the PVC tapes wrapped around each small hemp bundle make a poor appearance even after coating with paint. (5) The method of manufacture according to this invention is simple and fast, thus it improves productivity. The inventor's experiments reveal a fact that productivity with the method of this invention has been raised three times over that with the conventional method, and that the quality of the product is better, and the cost, less.

BRIEF DESCRIPTION OF THE DRAWING

The method and equipment of this invention will be more fully understood from the following description in a detailed step by step manner taken in conjunction with the accompanying drawings, in which.

DETAILED DESCRIPTION OF THE INVENTION

Figure 2:
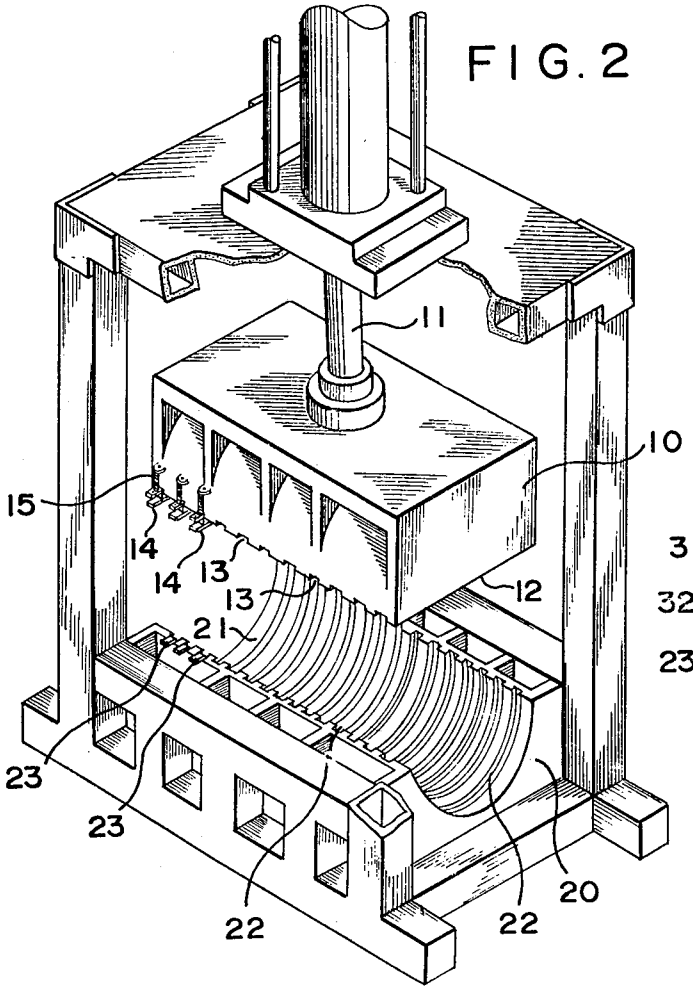
FIG. 2 is a perspective, composite view of the press-forming device of this invention.
Figure 4:
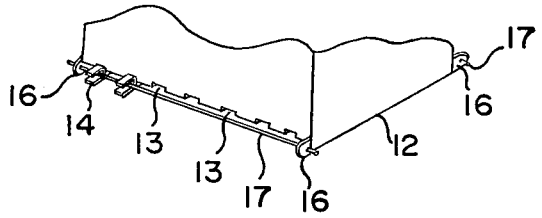
FIG. 4 is a schematic view of a holding bar holding the upper members of the clamps.

The press-forming device of this invention is as shown in FIG. 2, mainly consisting of an upper mold connected with a hydraulic plunger 11 which forces the upper mold to press downward. The mold face 12 of said upper mold is a straight plane provided with plurality of straight grooves 13—13 equally spaced at the pitch which is equal to the thickness of the target board, said straight grooves 13—13 are designed to receive in each groove, respectively, a slender, rectangular upper clamp member 14—14 having a thickness equal to the depth of a groove 13, said upper clamp member having both ends protruding outwardly from the groove 13 and hooked onto a spring 15 provided at both sides of the upper mold. A lower mold 20 is provided with a large, semi-cylindrical cavity 21 having a plurality of equally spaced semi-circular grooves 22 on the cavity wall, said semi-circular grooves 22 are designed so that each semi-circular groove 22 faces a corresponding straight groove 13 on the upper mold respectively, and so that each semi-circular groove 22 receives therein, respectively, a semi-circular lower clamp member 23 having both sides protruding outwardly from each groove 22.

Figure 3:
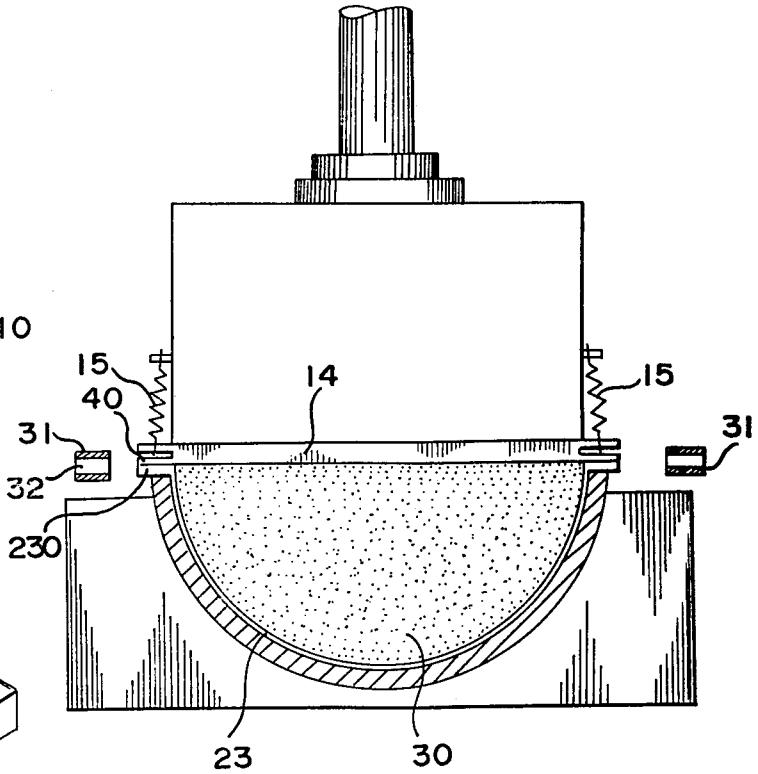
FIG. 3 is a sectional view of the upper and lower molds in press-forming action.

To operate the press-forming device, first of all, a large bunch of hemp fibers are placed in the large semi-cylindrical cavity 21 on the lower mold 20 till the mold is properly filled; then the hydraulic plunger 11 is actuated to force the upper mold 10 to more downwardly, whereby the hemp fibers in between the upper and lower molds are pressed tightly as the mold face 12 moves down to contact with the hemp fibers and continues to move down; as soon as the upper and lower molds 10, 20 close completely, i.e., the upper mold 10 completes its press-forming stroke, the hemp fibers are press-formed into a tightly pressed hemp bundle 30 as shown by the sectional view in FIG. 3. When the upper and lower molds close completely, the ends of each set of upper and lower clamp members move into coincidence with each other. Then, the springs on which the upper clamp members are hooked are detached and, at the same time, each pair of the ends of the upper and lower clamp members coinciding with each other are linked together with a sleeve 31 (having a hole 32 therein) at projections 140 and 230 before the upper and lower molds are set aside in order to prevent the tightly pressed hemp bundle 30 from loosening because of the opening of the clamp members when the upper and lower molds open.

The springs 15 on the sides of the upper mold for holding each upper clamp member may be replaced with an arrangement that comprises four brackets 16 wherein each bracket has a hole and is provided at each of the four corners of the upper mold in such a manner that two brackets face side to side with each other and are provided with a bar 17, respectively, which is placed through the holes of said each two brackets and disposed in between, said bar 17 being arranged to hang the upper clamp members 14 on to the upper mold, keeping said upper clamp members 14 in the groove 14—14 as a substitute for the springs 15. In this case, the bars 17 can be removed as soon as the mold face 12 of the upper mold 10 comes in contact with the hemp fibers (at this moment the upper clamp members 14 will not fall off the grooves as they are already being supported by the hemp fibers), and then following the same procedure as described above, the sleeves 31 are put on the ends of the clamp members as soon as they coincide with each other when the upper and lower molds close.

Figure 5:
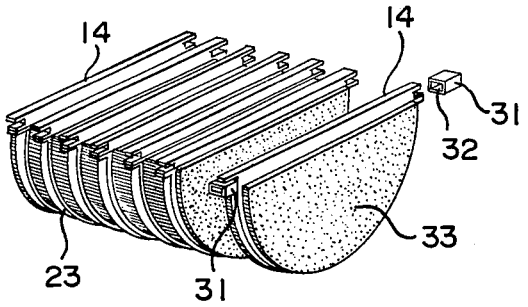
FIG. 5 is a perspective, exploded view of the tightly pressed semi-cylindrical hemp bundle and the tightly pressed semi-circular hemp board separated therefrom.
Figure 6:
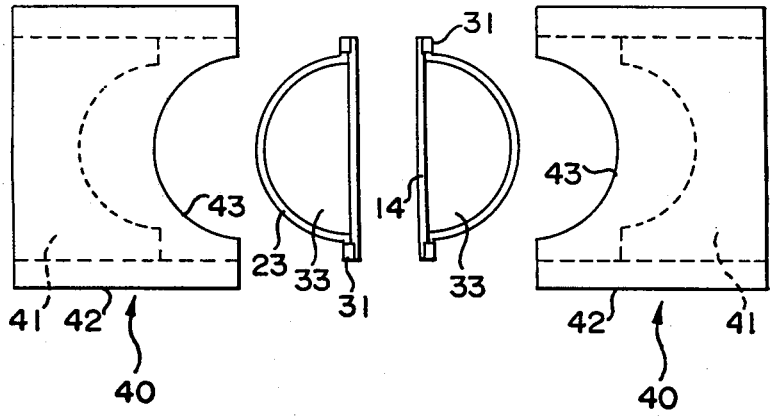
FIG. 6, 6A, 6B and 6C are schematic views of the joining device of this invention in action.
Figure 6A:
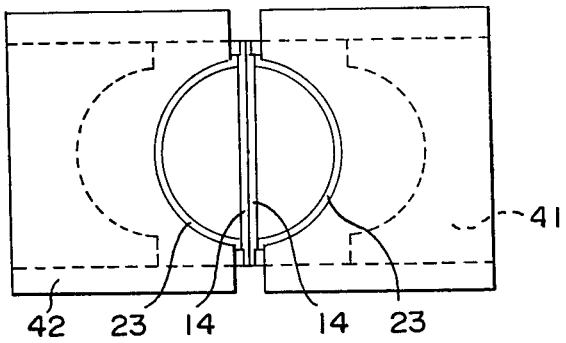
Figure 6B:
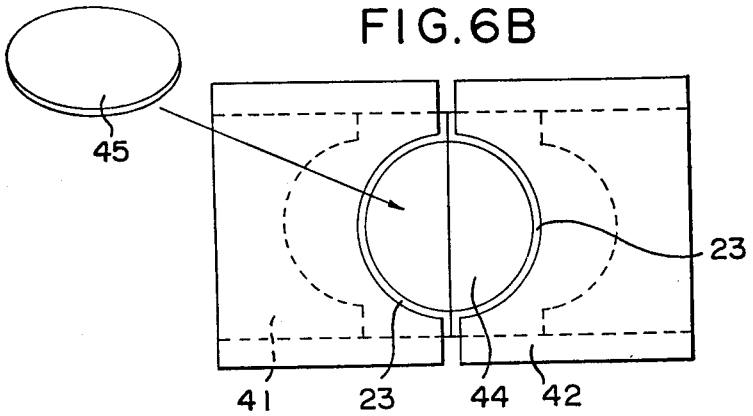

The tightly pressed hemp bundle 30 taken off the press-forming device after the press-forming process becomes a semi-cylindrical hemp bundle as shown in FIG. 5, which is then cut apart with a sawing machine (not shown) along the middle in between each two adjacent pairs of clamp members into plurality of tightly pressed semi-circular boards of predetermined thickness, such as board as 33, with each pair of the clamp members remaining on in order to prevent the board 33 from deformation. Then, referring to FIG. 6, two pieces of tightly pressed semi-circular boards 33 are placed in between two joining devices 40, each having an inner mold 41 and an outer mold 42, said inner mold being moved in the outer mold 42, said outer mold having a semi-circular mold face profile 43 to fit the semi-circular profile of the tightly pressed semi-circular board. In the joining operation, first, the two tightly pressed semi-circular boards 33 are clamped by the outer molds 42 as shown in FIG. 6A, and then, with the two semi-circular boards held together by the molds 42, the sleeves 31 linking the upper and lower clamp members are removed, and next, the upper clamp members are pulled off, then the outer molds 42 are further forced inwardly to press the two semi-circular boards together with increased pressure (see FIG. 6B). With the upper clamp members pulled off, the two semi-circular boards are then joined together as the hemp fibers at the junction are forced to bind together, a circular target board body 44 being thereby constituted. Then, with the board still held by the mold, glue is applied to the upper surface of the circular target board body 44 and a reinforcing plate 45 of the same diameter as the circular target board body 44 is attached thereon.

Figure 1:
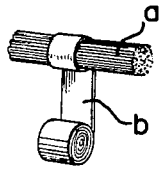
FIG. 1, 1A, 1B and 1C are simplified schematic views showing the conventional method.
Figure 1A:
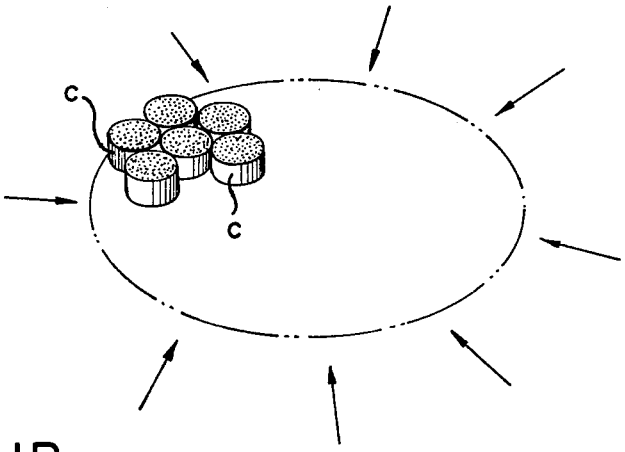
Figure 1B:
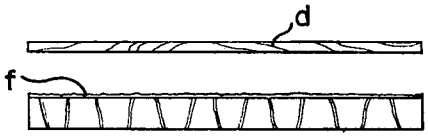
Figure 1C:
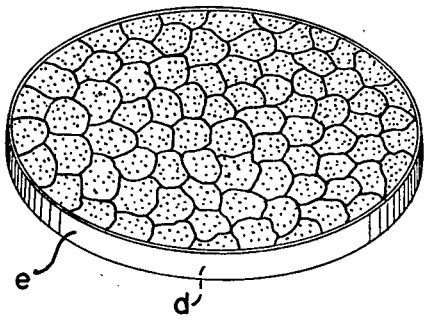
Figure 8:
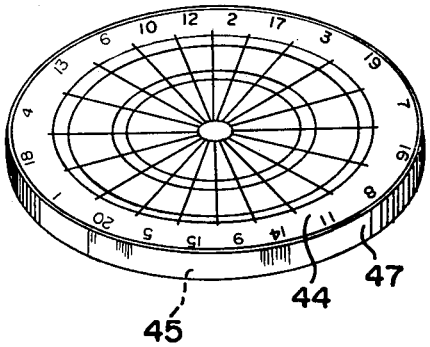
FIG. 8 is an oblique view of the complete product manufactured according to this invention, showing its appearance.
Figure 7:
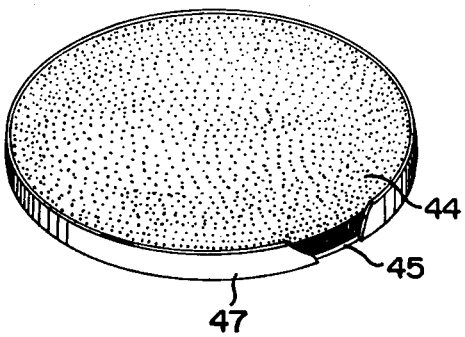
FIG. 7 is a perspective, schematic view of the circular target board body manufactured according to this invention.
Figure 6C:
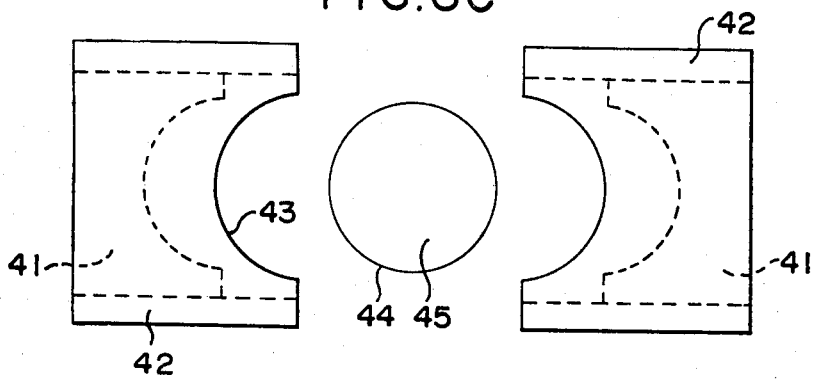
Figure 6D:
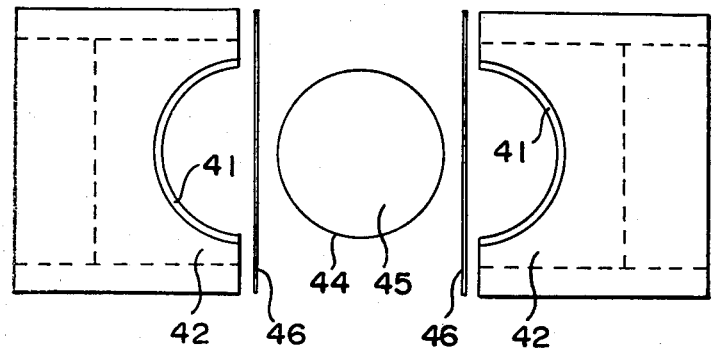

The two outer molds 42 are released as soon as the glue is cured and the reinforcing plate 45 is bonded securely on the circular target board body 44 (as shown in FIG. 6C), and then the two lower clamp members 23 are removed. Then, referring to FIG. 6D, and FIG. 7, to facilitate the fixing of a protecting ring 47 on the periphery of the circular target board body 44, the two inner molds 41 are pushed toward the mold faces, said protecting ring 47 being contituted by two semi-circular metal plates secured together by means of rivets. Meantime, two pieces of metal strips 46—46 (to be used as a protecting ring) are placed in between the circular target board 44 and the molds, and then both of the inner and outer molds are forced to move inwardly and press on the circular target board body 44 to fix the protecting ring 47 on the periphery of the circular target board body 44. Finally, the decoration covering is put on the surface of the target board body to become the completed product of a nice looking target board for darts or archery.

The operation of aforesaid joining device has been given in precise detail in order that the operation can be fully and clearly understood, however, in the actual operation the whole process can be performed in a very short period of time, and furthermore, it is much faster and easier than known methods. Therefore, the method of this invention not only improves productivity, but it also eliminates the waste of PVC tapes and beautifies the appearance of the target board for darts or archery and thus increases the effectiveness of application. The method of the present disclosure provides a target board which is stronger, and lasts longer than prior boards; the present board also undergoes little, or no deformation.

What I claimed is:

1. A method of forming a target board for darts or archery comprising the steps of:

providing a planar upper mold face with a plurality of straight grooves, said grooves being equally spaced at a pitch equal to the thickness of a target board;

providing an arcuate lower mold face with a plurality of arcuate grooves which correspond in position and pitch with said straight grooves;

placing an upper clamp member in each of said straight grooves;

releasably attaching said upper clamp members to said upper mold face;

placing a lower clamp member in each of said arcuate grooves;

placing a bunch of hemp fibers on said arcuate lower mold face;

forcing said upper mold face toward said lower mold face and tightly pressing said bunch of hemp fibers into a tightly pressed hemp bundle;

detaching said upper clamp members from said upper mold face;

releasably coupling each of said upper clamp members to a corresponding one of said lower clamp members to maintain said hemp fibers tightly pressed together;

moving said upper mold face away from said hemp bundle;

removing said hemp bundle and clamp members from said lower mold face with said clamp members remaining on said bundle;

cutting said hemp bundle between said clamp members and forming a plurality of clamped semi-circular board pieces;

placing each of a pair of clamped board pieces in a mold with a planar portion of each piece facing a planar portion of the other piece;

forcing said pair of pieces together to form a circular board having a pair of planar faces;

decoupling said clamp members on each piece;

removing said decoupled clamp members from each piece of said pair of pieces;

increasing the pressure pressing said pieces of said pair of pieces together;

applying adhesive to one of said board planar faces;

adhering a reinforcing plate to said one board planar face while said board remains under pressure;

releasing said board;

placing a pair of ring members adjacent the circular periphery of said board;

forcing said ring members around said board periphery;

securing said ring members together to form a protective ring around the outer periphery of said board; and placing decoration on said reinforcing plate.

* * * * *